US005141567A

United States Patent [19]

Tahara et al.

[11] Patent Number: 5,141,567

[45] Date of Patent: * Aug. 25, 1992

[54] METHOD OF NITRIDING STEEL

[75] Inventors: Masaaki Tahara, Takatsuki; Takakazu Tomoda, Sennan; Kenzo Kitano, Kawachinagano; Teruo Minato, Hashimoto, all of Japan

[73] Assignee: Daidousanso Co., Ltd, Osaka, Japan

[ * ] Notice: The portion of the term of this patent subsequent to May 7, 2008 has been disclaimed.

[21] Appl. No.: 643,953

[22] Filed: Jan. 22, 1991

Related U.S. Application Data

[63] Continuation-in-part of Ser. No. 479,013, Feb. 12, 1990, Pat. No. 5,013,371.

[30] Foreign Application Priority Data

Jul. 10, 1989 [JP] Japan ..... 1-177660

[51] Int. Cl.[5] ..... C21D 1/06

[52] U.S. Cl. ..... 148/217; 148/230

[58] Field of Search ..... 148/14, 16.6, 20.3, 148/283; 427/255.4

[56] References Cited

U.S. PATENT DOCUMENTS 5,013,371 5/1991 Tahara et al. ..... 148/16.6

*Primary Examiner*—R. Dean
*Assistant Examiner*—Robert R. Koehler
*Attorney, Agent, or Firm*—Armstrong & Kubovcik

[57] ABSTRACT

Steel is nitrided first by treating the steel to be nitrided with $NF_3$ at elevated temperatures to form a fluorinated layer on the steel, and then the steel is nitrided by heating in a nitriding atmosphere.

1 Claim, 3 Drawing Sheets

METHOD OF NITRIDING STEEL

This is a continuation-in-part application of Ser. No. 07/479,013 filed on Feb. 12, 1990, now U.S. Pat. No. 5,013,371.

FIELD OF THE INVENTION

This invention relates to a method steel for the improvement of wear resistance and other properties by forming a nitrided layer on the steel surface.

BACKGROUND OF THE INVENTION

The methods of nitriding or carbonitriding steel articles or works for the formation of a nitrided layer on their surface which have been so far employed for the purpose of improving their mechanical properties, such as wear resistance, corrosion resistance and fatigue strength, include the following, among others:

(a) The method of using a molten cyanate or cyanide salt, such as NaCN or KCN (tufftriding method);

(b) The glow discharge nitriding method (ionitriding method); and (c) The method using ammonia or a mixed gas containing ammonia and a carbon source, for example RX gas (gas nitriding or gas soft nitriding method).

Among these, method (a), which uses hazardous molten salts, has a dark future when evaluated from the labor environment, waste treatment and other viewpoints. Method (b), which achieves nitriding by means of glow discharge in an $N_2+H_2$ atmosphere under a low degree of vacuum, can indeed avoid, to a considerable extent, the staining of the steel surface or the influences of oxidized layer formation owing to some cleaning effect of sputtering but tends to allow occurrence of uneven nitriding due to local temperature differences. In addition, this method is disadvantageous in that articles or works which can be nitrided are much limited in shape and size and that increases in cost result Method (c) also has problems, for instance, the treatment process is not very stable but tends to lead to uneven nitriding Another problem lies in that deep nitriding requires a fairly long time.

Generally, steel is nitrided at temperatures not lower than 500° C. For the adsorption and diffusion of nitrogen on the steel surface layer, it is desired that the surface should be free not only of organic and inorganic contaminants but also of any oxidized layer or adsorbed $O_2$ layer It is also necessary that the steel surface layer itself should be highly active. The above-mentioned oxidized layer, if present, would unfavorably promote dissociation of the nitriding gas ammonia. In practice, however, it is impossible to prevent oxidized layer formation in gas nitriding. For instance, even in the case of case hardened steel or structural steel whose chromium content is not high, thin oxidized layers are formed even in an high concentration hydrogen atmosphere or an $NH_3$ or $NH_3+RX$ atmosphere at temperatures not higher than about 500° C. This tendency becomes more pronounced with steel species containing an element or elements which have high affinity for oxygen, for example chromium, in large amounts. Works made of this kind of steel must be deprived of inorganic and organic contaminants prior to nitriding by degreasing with an alkaline cleaning solution or washing with an organic solvent such as trichloroethylene. However, in view of the recent regulations against environmental pollution (regulations against destruction of the ozone layer), the use of organic solvents with highest cleaning effects should be avoided and this is another problem.

The oxide formation on the steel surface, such as mentioned above, varies in extent depending on the surface state, working conditions and other factors even in one and the same work, resulting in unevenly nitrided layer formation. For example, in the typical case of work hardened austenite stainless steel works, satisfactory nitrided layer formation is almost impossible even if passive surface coat layers are completely removed prior to charging into a treatment furnace by cleaning with a hydrofluoric acid-nitric acid mixture. Uneven nitriding occurs not only in gas soft nitriding but also in nitriding of nitriding steel or stainless steel with ammonia alone (gas nitriding). Furthermore, in the case of works complicated in geometry, for example gears, even when they are made of ordinary structural steel, it is a fundamental problem that there is a general tendency to uneven nitriding.

The means or methods so far proposed for solving the above-mentioned essential problems encountered in gas nitriding and gas soft nitriding include, among others, the one comprising charging a vinyl chloride resin into a furnace together with works, the one comprising sprinkling works with chlorine, $CH_3Cl$ or the like and heating at 200–300° C. to thereby cause evolution of HCl and prevent oxide formation and remove oxides therewith, and the one comprising plating works in advance to thereby prevent oxide formation. Practically none of them have been put into practical use, however. Where chlorine or a chloride is used, chlorides such as $FeCl_2$, $FeCl_3$ and $CrCl_3$ are formed on the steel surface. These chlorides are very fragile at temperatures below the nitriding temperature and can readily sublime or vaporize, damaging furnace materials badly. In particular, $CrCl_3$ can sublime very readily, so that Cr deficiency may readily result in addition to the drawbacks mentioned above. Furthermore, the handling of the above-mentioned chlorides and the like is troublesome, although they are effective to some extent in preventing oxidized layer formation. Thus, none of the methods mentioned above can be said to be practicable. Accordingly it is an object of the invention to provide a method of nitriding steel by which a uniformly nitrided layer can be formed on the steel surface without unevenness in nitriding.

SUMMARY OF THE INVENTION

In accordance with the invention, the above object can be accomplished by providing a method of nitriding steel by reacting the surface of steel articles or works with nitrogen for the formation of a hard nitride layer thereon which comprises preliminarily holding a steel work in a fluorine- or fluoride-containing gas atmosphere and, after formation of a fluorinated layer on the surface of the work, heating the steel work in a nitriding atmosphere for the formation of a nitrided layer ,on the surface thereof.

DETAILED DESCRIPTION OF THE INVENTION

The term "fluorine- or fluoride-containing gas" as used herein means a dilution of at least one fluorine source component selected from among $NF_3$, $BF_3$, $CF_4$, HF, $SF_6$ and $F_2$ in an inert gas such as $N_2$. Among these fluorine source components, $NF_3$ is most suited for practical use since it is superior in reactivity, ease of handling and other aspects to the other. Steel works or the like are held in the above-mentioned fluorine- or fluoride-containing gas atmosphere at a temperature of, for example 150-500° C. in the case of $NF_3$, for the preliminary treatment of the steel surface and then subjected to nitriding (or carbonitriding) using a known nitriding gas such as ammonia. The concentration of the fluorine source component, such as $NF_3$, in such fluorine- or fluoride-containing gas should amount to, for example, 1,000-100,000 ppm, preferably 20,000-70,000 ppm, more preferably 30,000-50,000 ppm. The holding time in such fluorine- or fluoride-containing gas atmosphere may appropriately be selected depending on the steel species, geometry and dimensions of the works, heating temperature and so forth, generally within the range of ten and odd minutes to scores of minutes.

Figure 1:
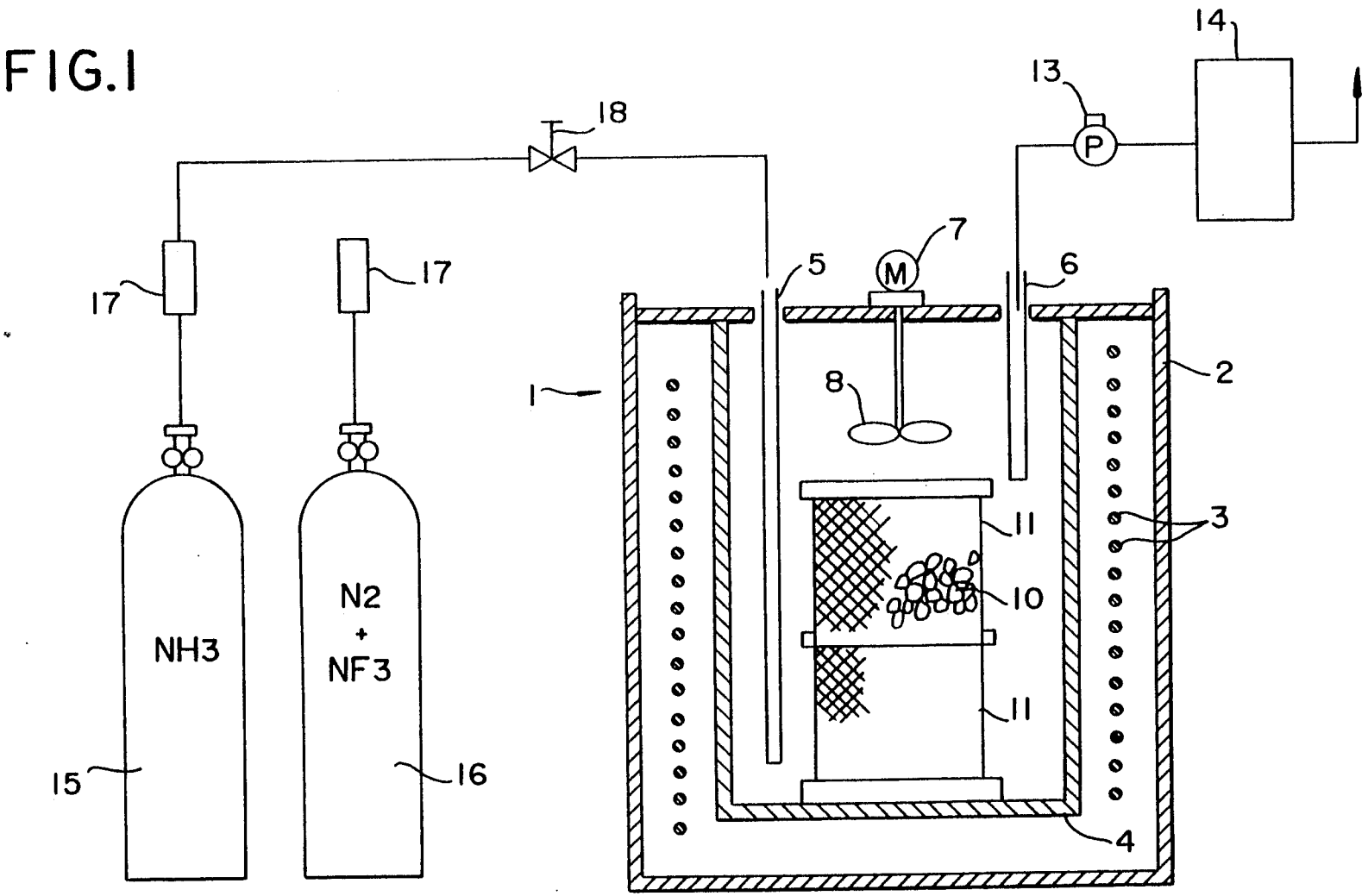
FIG. 1 schematically shows, in cross section, an example of the treatment furnace for carrying out the method of the invention.

To be more concrete, the method of the invention may be illustrated as follows. Steel works are cleaned for degreasing, for instance, and then charged into a heat treatment furnace 1 such as shown in FIG. 1. This furnace 1 is a pit furnace comprising an inner vessel 4 surrounded by a heater 3 disposed within an outer shell 2, with a gas inlet pipe 5 and an exhaust pipe 6 being inserted therein. Gas supply is made from cylinders 15 and 16 via flow meters 17, a valve 18 and so on and via the gas inlet pipe 5. The inside atmosphere is stirred by means of a fan 8 driven by a motor 7. Works 10 placed in a metal container 11 are charged into the furnace. In FIG. 1, the reference numeral 13 indicates a vacuum pump and 14 a noxious substance eliminator. A fluorine- or fluoride-containing reaction gas, for example a mixed gas composed of $NF_3$ and $N_2$, is introduced into this furnace and heated, together with the works,, at a specified reaction temperature. At temperatures of 150-500° C., $NF_3$ evolves fluorine in the nascent state, whereby the organic and inorganic contaminants on the steel work surface are eliminated therefrom and at the same time this fluorine rapidly reacts with the base elements Fe and chromium on the surface and/or with oxides occurring on the steel work surface, such as FeO, $Fe_3O_2$ and $Cr_2O_3$. As a result, a very thin fluorinated layer containing such compounds as $FeF_2$, $FeF_3$, $CrF_2$ and $CrF_4$ in the metal structure is formed on the surface, for example as follows:

$$FeO+2F \rightarrow FeF_2+1/2O_2;$$

$$Cr_2O_3+4F \rightarrow 2CrF_2+3/2O_2.$$

These reactions convert the oxidized layer on the work surface to a fluorinated layer. At the same time, $O_2$ adsorbed on the surface is removed therefrom. Where $O_2$, $H_2$ and $H_2O$ are absent, such fluorinated layer is stable at temperatures up to 600° C. and can presumably prevent oxidized layer formation on the metal base and adsorption of $O_2$ thereon until the subsequent step of nitriding. A fluorinated layer, which is similarly stable, is formed on the furnace material surface as well and minimizes the damage to the furnace material surface.

The works thus treated with such fluorine- or fluoride-containing reaction gas are then heated at a nitriding temperature of 480-700° C. Upon addition of $NH_3$ or a mixed gas composed of $NH_3$ and a carbon source gas (e.g. RX gas), the fluorinated layer supposedly undergoes reduction or destruction by means of $H_2$ or a trace amount of water to give an active metal base, as shown, for example, by the following reaction equations:

$$CrF_4+2\ H_2 \rightarrow Cr+4HF;$$

$$2\ FeF_3+3\ H_2 \rightarrow 2\ Fe+6\ HF.$$

Upon formation of such active metal base, active N atoms are adsorbed thereon, then enter the metal structure and diffuse therein and, as a result, a layer (nitride layer) containing such nitrides as CrN, $Fe_2N$, $Fe_3N$ and $Fe_4N$ is formed on the surface.

A layer containing such compounds is formed in the prior art processes as well. In the known processes, however, the surface activity of the works is reduced by oxidized layer formation and $O_2$ adsorption during the period of temperature rise from ordinary temperature to the nitriding temperature. Therefore, in the nitriding step, the adsorption of N atoms on the surface is low in degree and uneven. Such unevenness in N adsorption is promoted by the fact that it is practically impossible to maintain a uniform extend or rate of decomposition of $NH_3$ in the furnace. In the process according to the invention, N atoms are adsorbed on the work surface uniformly and rapidly, hence the problem mentioned above is never encountered.

From the operational process viewpoint, it is an outstanding feature of the invention that, as a result of the use, as the reactant gas for fluorinated layer formation, of such a gaseous substance as $NF_3$, which shows no reactivity at ordinary temperature and can be handled with ease, the process is simplified, for example continuous treatment becomes possible, as compared with the processes which involve plating treatment or use of PVC, which is a solid, or a liquid chlorine source. The tufftriding process can hardly be said to have a bright future since a great expenditure is required for work environment improvement and environmental pollution prevention, for instance, although it is excellent in promoting nitrided layer formation and increasing fatigue strength, among others. On the contrary, the above-mentioned process according to the invention requires only a simple device for eliminating hazardous substances from the exhaust waste gas, and allows at least the same extent of nitrided layer formation as in the tufftriding process and thereby makes it possible to avoid uneven nitriding. While nitriding is accompanied by carburizing in the tufftriding process, it is possible to perform nitriding alone in the process according to the invention.

As mentioned hereinabove, the steel nitriding method according to the invention comprises holding steel works with heating in a fluorine- or fluoride-containing gas atmosphere to thereby eliminate organic and inorganic contaminants and at the same time cause the passive coat layer, such as an oxidized layer, on the steel work surface to be converted to a fluorinated layer, and then subjecting the works to nitriding treatment. Since the oxidized layer or the like passive coat layer on the steel work surface is converted to a fluorinated layer in that manner, the steel work surface is protected in a good state. Therefore, even after the lapse of a certain period from the time of fluorinated layer formation to the time of nitriding, the fluorinated layer formed on the steel work surface remains in a good condition, still protecting the steel work surface, As a result, no oxidized layer can be formed again on the steel work surface In the subsequent treatment with $H_2$, for instance, such fluorinated layer is decomposed and eliminated, whereby a new steel work surface appears. This newly exposed metal surface is in an active condition, allowing N atoms to penetrate readily into the steel works subjected to nitriding treatment. The resulting uniform penetration of N atoms from the steel work surface in the depth leads to formation of a favorable nitrided layer. In particular, the fluorine- or fluoride-containing gas to be used in accordance with the invention in the pretreatment step prior to nitriding treatment is a gas which shows no reactivity at ordinary temperature and can be handled with ease, for example $NF_3$, and therefore the pretreatment step can be simplified by carrying out the step in a continuous manner, for instance.

The following best modes for carrying out the invention illustrate the invention in further detail.

EXAMPLE 1 AND COMPARATIVE EXAMPLE 1

Work-hardened SUS 305 stainless steel works (screws) were cleaned with trichloroethylene, then charged into such a treatment furnace 1 as shown in FIG. 1, and held at 300° C. in an $N_2$ gas atmosphere containing 5,000 ppm of $NF_3$ for 15 minutes. Then they were heated to 530° C., and nitriding treatment was carried out at that temperature for 3 hours while a mixed gas composed of 50% $NH_3$ plus 50% $N_2$ was introduced into the furnace The works were then air-cooled and taken out of the furnace.

The nitrided layer of each work thus obtained was uniform in thickness. The surface hardness was 1,100–1,300 Hv while the base material portion had a hardness of 360–380 Hv.

In Comparative Example 1, the same works as used in Example 1 were cleaned with trichloroethylene, treated with a mixture of hydrofluoric acid and nitric acid, placed in the furnace mentioned above, and heated in 75% $NH_3$ at 530° C. or 570° C. for 3 hours. In either case, great variations were found in the thickness of the nitrided layer formed. The proportion of portions having no nitrided layer at all was high.

Figure 2:
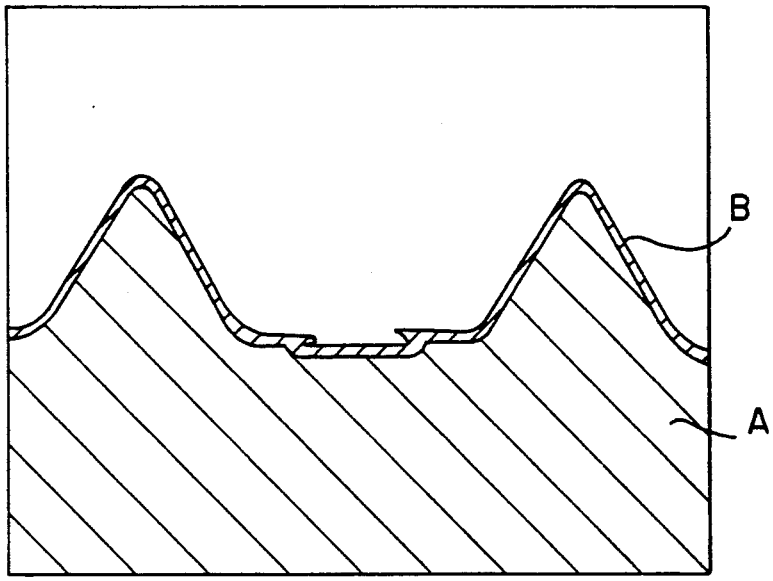
FIG. 2 is a schematic representation of a cross-sectional photomicrograph (magnification: 50) of a portion of the thread ridge of a work treated in accordance with the invention as described in Example 1.
Figure 3:
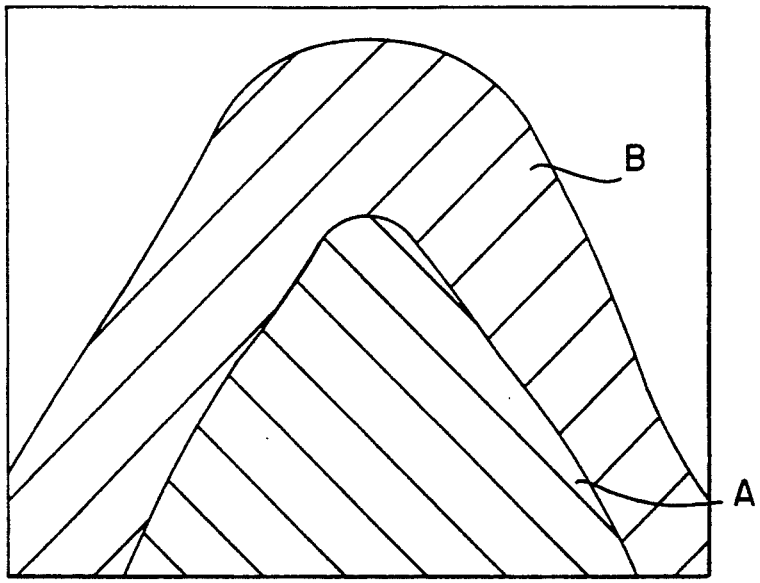
FIG. 3 is a schematic representation of a cross-sectional photomicrograph (magnification: 500) of a portion of the thread ridge of a work treated in the same working example.
Figure 4:
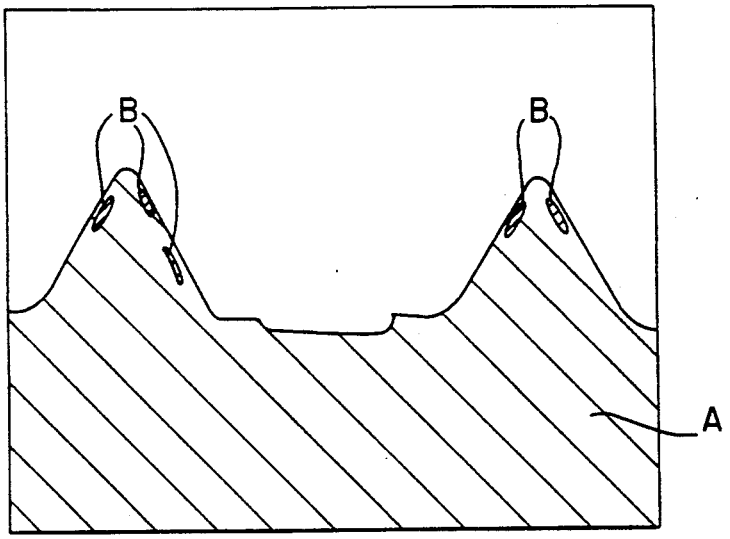
FIG. 4 is a schematic representation of a cross-sectional photomicrograph (magnification: 50) of a portion of the thread ridge of a work treated as described in Comparative Example 1.

Photomicrographs of the works obtained in the above-mentioned example and example for comparison, respectively taken in the vicinity of the surface, are shown in FIG. 2 and FIG. 3 (example) and FIG. 4 (comparative example).

EXAMPLE 2

SUS 305 stainless steel tapping screws were cleaned with acetone, placed in the furnace shown in FIG. 1, held in an $N_2$ atmosphere containing 5,000 ppm of $NF_3$ at 280° C. for 15 minutes, then heated to 480° C., held in $N_2$ + 90% $H_2$ at that temperature for 30 minutes, nitrided in 20% $NH_3$ + 80% RX for 8 hours, the furnace.

A 40–50 μm thick nitrided layer was formed all over the screw surface. The surface hardness after surface polishing was Hv =950–1.100. The nitrided layer showed a corrosion resistance to 5% sulfuric acid which was not so inferior to that of the base material.

EXAMPLE 3 AND COMPARATIVE EXAMPLE 2

The works used in Example 3 were hot-worked molded parts polished by emery cloth (SKD 61). They were charged into the furnace shown in FIG. 1, heated in an $N_2$ atmosphere containing 3,000 ppm of $NF_3$ at 300° C. for 15–20 minutes, then heated to 570° C., and treated at that temperature with a mixed gas composed of 50% $NH_3$ and 50% $N_2$ for 3 hours. A uniform nitrided layer of a thickness of 120 μm was obtained with a surface hardness of 1,000–1,100 Hv (based material hardness 450–500 Hv).

In Comparative Example 2, the same parts as used in Example 3 were cleaned with hydrofluoric acid-nitric acid and then subjected to nitriding treatment at 570° C. for 3 hours. The nitrided layer thickness was at most 90–100 μm and great variations were found in said thickness. Severe surface roughening was also observed.

EXAMPLE 4

The temperature to be heated in a $N_2$ atmosphere containing 3,000 ppm of $NF_3$ is raised to 480° C., and time for heating is shortened to 10–12 minutes. Then hot-worked mold parts were nitrided in the same manner as in Example 3. Excellent nitrided layer was formed on thus obtained nitrided articles as well as in Example 3.

EXAMPLE 5 AND COMPARATIVE EXAMPLE 3

Nitriding steel (SACM 1) parts were cleaned, charged into the furnace shown in FIG. 1, held in an $N_2$ gas atmosphere containing 5,000 ppm of $NF_3$ at 280° C. for 20 minutes and then heated in 75% $NH_3$ at 550° C. for 12 hours. The nitrided layer obtained had a thickness of 0.42 mm. For comparison (Comparative Example 3), the same parts as above were nitrided in the conventional manner. The thickness of the nitrided layer was 0.28 mm.

EXAMPLE 6

Structural carbon steel (S45C) mold parts were cleaned, held in an atmosphere containing 5,000 ppm of $NF_3$ at 300° C. for 20 minutes, then treated at 530° C. with 50% $NH_3$ plus 50% RX for 4 hours, oil-quenched, and taken out. The nitrided layer obtained had a hardness of 450–480 Hv. These works were subjected to a rotary bending test. The fatigue strength was 44 $kg/mm^2$, being comparable or superior to that of the products gas soft nitrided in the conventional manner.

EXAMPLE 7

Work-hardened SUS 305 stainless steel works (screws) were subjected to nitriding treatment in the same manner as in Example 1 except that a mixed gas composed of 10% $NH_3$, 5% CO and 85% $N_2$ was used in lieu of the mixed gas composed of 50% $NH_3$ +50% $N_2$.

The nitrided layer of each work thus obtained had a uniform thickness. The depth of the nitrided layer was about 70 μm. The nitrided layer was more compact than that obtained in Example 1. The surface of the nitrided layer of the works thus obtained was polished and subjected to a corrosion test using sodium chloride and sulfuric acid. Still better results were obtained as compared with Example 1.

Figure 5:
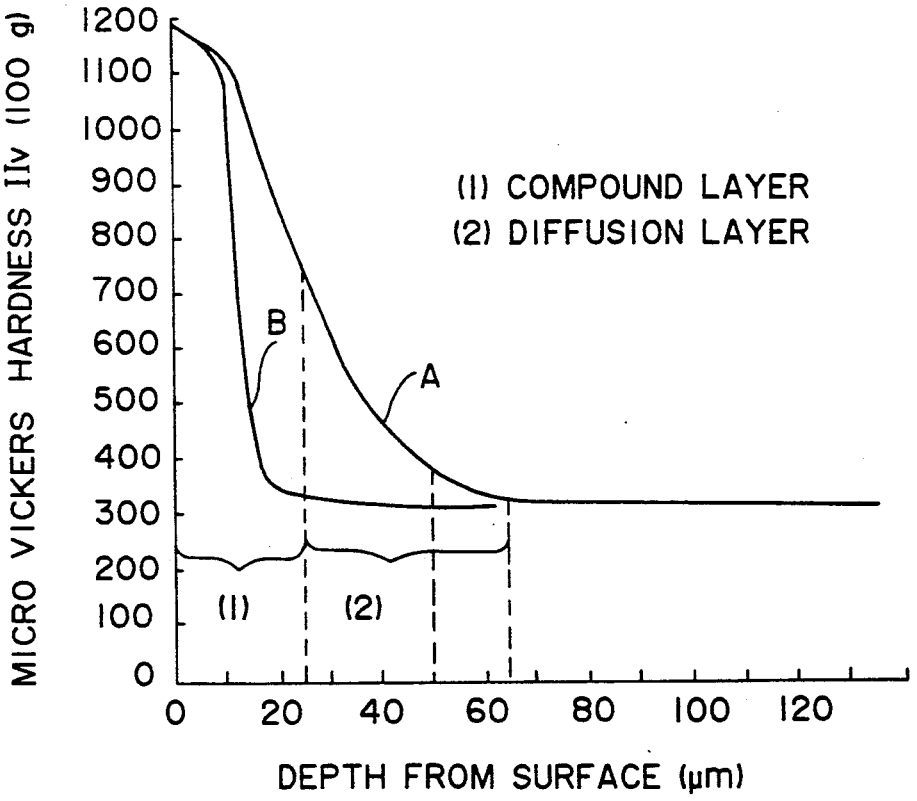
FIG. 5 shows the sectional hardness distribution in a work treated in accordance with the invention.

In this example, the $NH_3$ concentration in the mixed gas used for nitriding was below 25% and this is presumably why better nitrided layer formation, resulted as compared with the case where the $NH_3$ concentration exceeded 25%. Particularly when a mixed gas having such composition is used for nitrided layer formation, the nitrided layer comprised of a compound layer containing intermetallic compounds composed of N and Cr, Fe, etc., and a diffusion layer containing nitrogen atoms that have diffused shows a much higher diffusion layer/compound layer ratio, as shown by the curve A in FIG. 5, as compared with the corresponding ratio shown by the curve B for the conventional nitriding processes. This indicates that, in accordance with the invention, nitrided layers are obtained with a very good hardness gradient, which is different from the steep hardness decrease gradient in the prior art. The works nitrided in this example showed practically no difference in hardness between the thread ridge and the bottom.

EXAMPLE 8

Work-hardened SUS 305 stainless steel works (tapping screws) were cleaned with trichloroethylene, placed in a furnace other than the nitriding furnace, heated to 330° C., and held in the furnace at the temperature for 40 minutes while a mixed gas composed of $N_2$ gas and 20,000 ppm of $NF_3$ was introduced into the furnace. The works were then cooled with gaseous nitrogen and taken out of the furnace.

After the lapse of 3 hours, the works were charged into the nitriding furnace, heated at 530° C. and nitrided for 4 hours while feeding a mixed gas composed of 20% $NH_3$ +10% $CO_2$ +70% $N_2$ to the furnace.

The works thus obtained had a good and uniform nitrided layer, like the products obtained in Examples 1 and 2.

EXAMPLE 9 AND COMPARATIVE EXAMPLE 4

Work-hardened SCM 440 works (shafts) contaminated with a cutting oil were degreased with an alkali. Without cleaning with any organic solvent, they were placed in the treatment furnace 1, such as shown in FIG. 1, heated to 330° C., and held at that temperature in an $N_2$ gas atmosphere containing 30,000 ppm of $NF_3$ for 3 hours. Then, the temperature was raised to 570° C. while feeding gaseous $N_2$ in lieu of the mixed gas mentioned above. At that temperature, a mixed gas composed of 50% $N_2$ +50% $H_2$ was fed to the furnace for 40 minutes and then a mixed gas composed of 50% $NH_3$ +10% $CO_2$ +40% $N_2$ was introduced into the furnace for effecting nitriding for 3 hours.

In Comparative Example 4, the same cutting oil-contaminated work-hardened works as used in Example 9 were subjected to alkali cleaning, then directly charged into the furnace shown in FIG. 1, heated to 570° C., and nitrided at that temperature for 3 hours while feeding a mixed gas composed of 50% $NH_3$ +50% RX to the furnace.

The nitrided layers of both lots of works thus obtained were compared with each other. In Example 9, the nitrided layer had a micro Vickers hardness (Hv) of 350 and a nitrided layer depth of 180 μm whereas, in Comparative Example 4, the nitrided layer thickness was 40 μm. It is thus evident that the nitrided layer in the works obtained in Example 9 had a greater depth.

For further comparison, the work-hardened sample works were subjected to alkali cleaning and then further to cleaning with trichloroethylene. Then, they were nitrided in the same manner as in Comparative Example 4 for 3 hours using a mixed gas compound of 50% $NH_3$ +50% RX. Even in this case, the nitrided layer thickness could not exceed 95 μm.

What is claimed is:

1. A method of nitriding steel which comprises treating the steel with $NF_3$ gas at a temperature over 350° C. and not more than 500° C. to form a fluorinated layer on the surface of the steel, and then heating the fluorinated steel at 480–700° C. in a nitriding atmosphere to form a nitrided layer on the steel.

* * * * *

UNITED STATES PATENT AND TRADEMARK OFFICE

CERTIFICATE OF CORRECTION

PATENT NO. : 5,141,567

DATED : August 25, 1992

INVENTOR(S) : Masaaki TAHARA et al

It is certified that error appears in the above-indentified patent and that said Letters Patent is hereby corrected as shown below:

Column 1, line 42, change "ing Another" to --ing. Another--;

line 49, change "layer It" to --layer. It--.

Column 2, line 44, "Accordingly" should be indented as the beginning of a new paragraph.

Column 3, line 60, change "$Fe_3O_2$" to --$Fe_3O_4$--.

Column 5, line 18, change "face In" to --face. In--;

line 45, change "furnace The" to --furnace. The--.

Column 6, line 3, after "hours," insert --and taken out of--;

line 6, change "1.100" to --1,100--.

UNITED STATES PATENT AND TRADEMARK OFFICE

CERTIFICATE OF CORRECTION

PATENT NO. : 5,141,567

DATED : August 25, 1992

INVENTOR(S) : Masaaki TAHARA et al

It is certified that error appears in the above-indentified patent and that said Letters Patent is hereby corrected as shown below:

Column 8, line 28, change "in" to --of--.

Signed and Sealed this

Twelfth Day of October, 1993

*Attest:*

*Attesting Officer*

BRUCE LEHMAN

*Commissioner of Patents and Trademarks*